United States Patent [19]

McGettrick

[11] 4,039,275

[45] Aug. 2, 1977

[54] INFRARED ENERGY GENERATOR WITH ORIFICE PLATE

[76] Inventor: Charles A. McGettrick, 19447 Westover, Rocky River, Ohio 44114

[21] Appl. No.: 660,430

[22] Filed: Feb. 23, 1976

[51] Int. Cl.[2] ..... F23D 13/14

[52] U.S. Cl. ..... 431/329; 126/92 B

[58] Field of Search ..... 431/328, 329, 326, 7, 431/147; 126/92 B

[56] References Cited

U.S. PATENT DOCUMENTS

| | | | |
|---|---|---|---|
| 1,901,086 | 3/1933 | Cox | 431/328 X |
| 3,529,916 | 9/1970 | Krieger | 431/329 |
| 3,814,573 | 6/1974 | Karlovetz | 431/329 |
| 3,852,025 | 12/1974 | Placek | 431/329 |

*Primary Examiner*—Edward G. Favors

*Attorney, Agent, or Firm*—Donnelly, Maky, Renner & Otto

[57] ABSTRACT

An infrared energy generator, which is capable of effective operation when provided with fuel from a relatively low pressure supply, such as from a relatively mobile liquid propane tank, to radiate infrared energy over a relatively large output area, has an orifice plate in the plenum to impede fuel flow to the fuel output where combustion occurs. The orifice plate has openings therethrough to conduct fuel from one portion of the plenum, which is coupled to the fuel supply at a fuel input orifice, to another portion of the plenum, which leads to the fuel output, and the sum total of the cross-sectional areas of the openings in the orifice plate is smaller than the cross-sectional area of the fuel input orifice so that a back pressure is created in the one plenum portion to assure fuel flow at a suitable velocity in a positive direction toward the other plenum portion and subsequently to the fuel output, thereby to reduce or to eliminate the possibility of encountering a blow out or a backfire during operation.

19 Claims, 4 Drawing Figures

INFRARED ENERGY GENERATOR WITH ORIFICE PLATE

BACKGROUND OF THE INVENTION

The present invention is directed, as indicated, to an infrared energy generator or heater with an orifice plate that impedes fuel flow through the generator plenum to cause a back pressure therein, and, more particularly, is directed to a mobile infrared energy generator capable of operation with a relatively low pressure fuel supply, such as liquid propane, while providing an infrared energy output over a relatively large area.

A conventional infrared generator or heater, which generates and radiates an infrared energy output in response to combustion of a fuel input, may include a housing, a plenum chamber or the like within the housing, a fuel input to the plenum, a fuel output from the plenum, and a radiating screen exposed to the products of the fuel combustion occuring normally between the fuel output and the screen and responsive to the thermal energy of such combustion to radiate infrared energy as an output of the infrared heater. The radiated infrared energy may be used for a variety of purposes, including, for example, indoor heating, paint drying, melting of ice outdoors, etc. Most infrared generators or heaters, especially those that are relatively large and provide their infrared energy output over a relatively large area, say forty or more square inches at the heater output, typically are supplied with a natural gas fuel input, which usually is at a relatively high pressure, say on the order of eleven inches of water, from the utility company. The relatively high pressure of the fuel allows such infrared generators to operate usually without a blow out of the flame or a backfire at the fuel input orifice to the plenum, which might be caused by a wind or other ambient atmospheric pressure or the like variation.

The fuel pressure available to an infrared generator from a mobile fuel supply, such as a liquid propane tank, is much less than the fuel pressure from a natural gas supply, often being four inches of water or less. The loweroperating pressure, then, of liquid propane supplied infrared generators would then tend to cause such infrared generators to be much more responsive to wind, drafts, pressure, or other ambient atmospheric conditions and changes, whereby blow outs or backfires would be more likely to occur. Therefore, to avoid reducing or diluting the effective fuel pressure and the sensitivity to the ambient environmental conditions, prior art mobile infrared generators supplied, for example, with vaporized or gaseous propane from a relatively mobile liquid propane fuel tank have been limited to relatively small sizes, for example, of several, usually less than four, square inches of radiating output surfaces.

SUMMARY OF THE INVENTION

In the present invention a fuel flow impediment is located in the infrared generator between the fuel input to the plenum and the fuel output therefrom to increase the fuel pressure or, in other words, to provide a back pressure, in the plenum between the fuel input and the flow impediment. That back pressure created by the flow impediment helps to maintain fuel flow in a positive direction, that is, in a direction from the input orifice of the plenum toward the fuel output of the plenum for subsequent fuel combustion. The maintained positive fuel flow, even when the fuel supply is a relatively low pressure pre-mixture of vaporized liquid propane and air, allows the infrared generator to be mobile, supplied by a mobile liquid propane tank fuel supply, while still being able to radiate an infrared energy output over a relatively large area, for example, larger than four square inches and usually larger even than 40 square inches.

Due to its mobility and relative insensitivity to wind and atmospheric pressure, the infrared generator of the present invention is especially suited for use outdoors. In one such use, the infrared heater of the invention is employed to expedite drying of an earth road bed to condition the latter for subsequent preparation preliminarily to the pouring of a concrete highway or the like. By directing the infrared energy toward a relatively large area of moist earth, for example, evaporation of the moisture is increased so that the road bed is efficiently dried and readied for subsequent preparation, etc. Moreover, the flow impediment created back pressure also allows several infrared generators to operate successfully while supplied from a common liquid propane tank or other mobile fuel supply, whereby when mounted on a vehicle, the infrared generators can heat simultaneously several adjacent areas to cover the entire width of the road bed.

In one embodiment of the invention the flow impediment comprises an orifice plate located in a housing within which the plenum is formed. The orifice plate is secured about its periphery in fluid tight engagement with the housing, for example, by welding or the like, and a plurality of holes through the orifice plate are distributed over the surface area thereof to effect a relatively uniform delivery of fuel to the fuel output of the plenum. In order to maintain the back pressure in the plenum chamber behind the orifice plate, the sum total of the area of the holes through the orifice plate is preferably smaller than the area of the fuel input orifice to the plenum. For example, the total cross-sectional area of the holes may be on the order of from about 15% to about 40% less than the total cross-sectional area of the fuel input orifice and preferably is approximately in the range of from 20% to about 30% less.

With the foregoing in mind it is a primary object of the invention to provide an infrared energy generator improved in the noted respects, and especially an infrared generator operable to provide an infrared energy output over a relatively large area while being supplied with fuel from a relatively low pressure fuel supply.

Another object is to provide a mobile infrared generator, and especially one capable of radiating an infrared energy output over a relatively large area.

An additional object is to reduce and/or to eliminate the possibility of occurrence of a blow out in an infrared generator.

A further object is to reduce and/or to eliminate the possibility of occurrence of a flashback or backfire in an infrared generator.

Still another object is to provide a back pressure in the plenum of an infrared generator that is of a magnitude greater than the ambient pressure.

Still an additional object is to expedite the drying of a road bed or the like, especially by using the infrared energy radiated by an infrared generator.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 4 is a section view looking generally in the direction of the arrows 4—4 of FIG. 2.

DESCRIPTION OF THE PREFERRED EMBODIMENT

Figure 1:
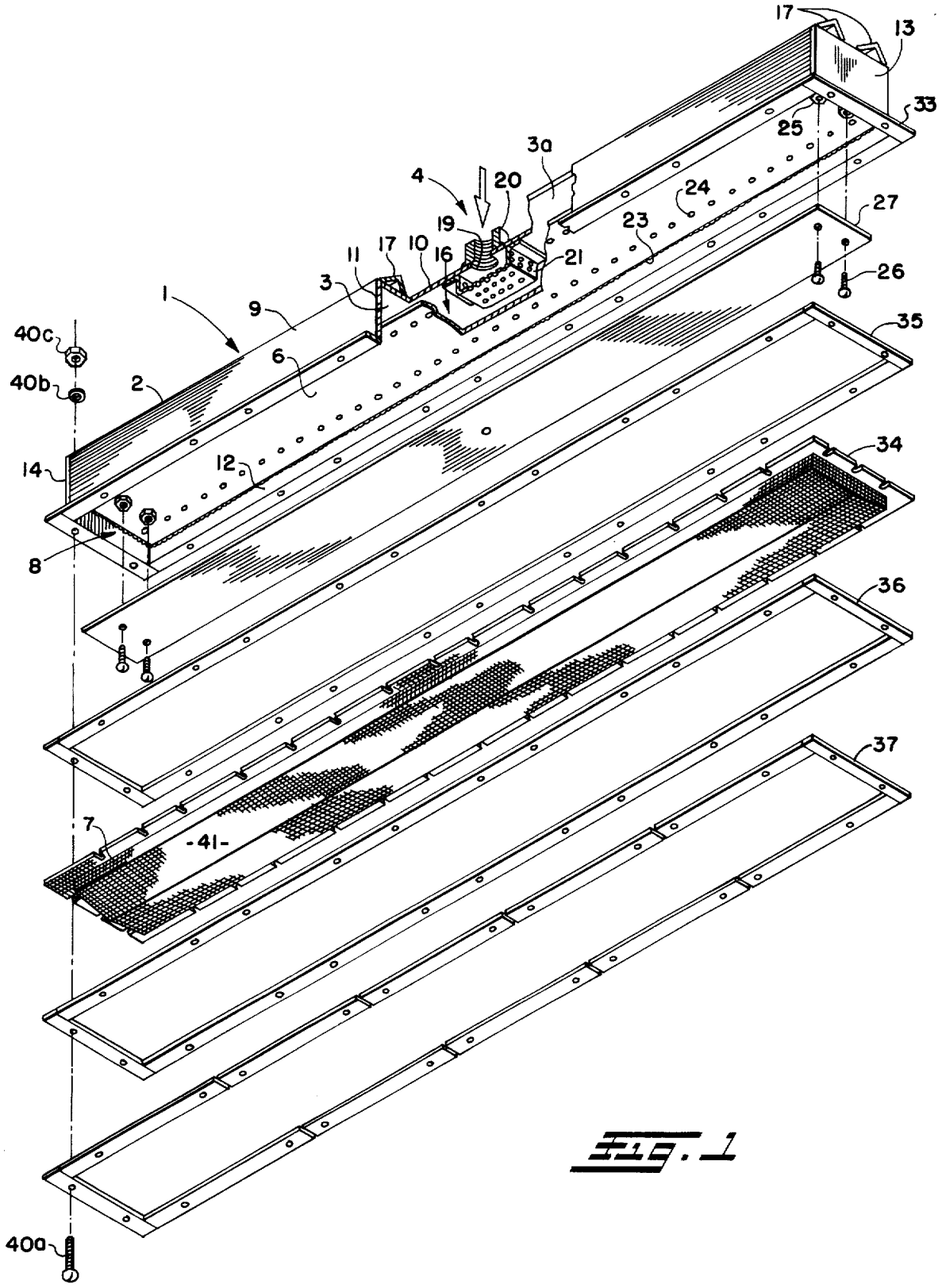
FIG. 1 is an exploded isometric view, partly broken away in section, of an infrared energy generator in accordance with the invention.
Figure 2:
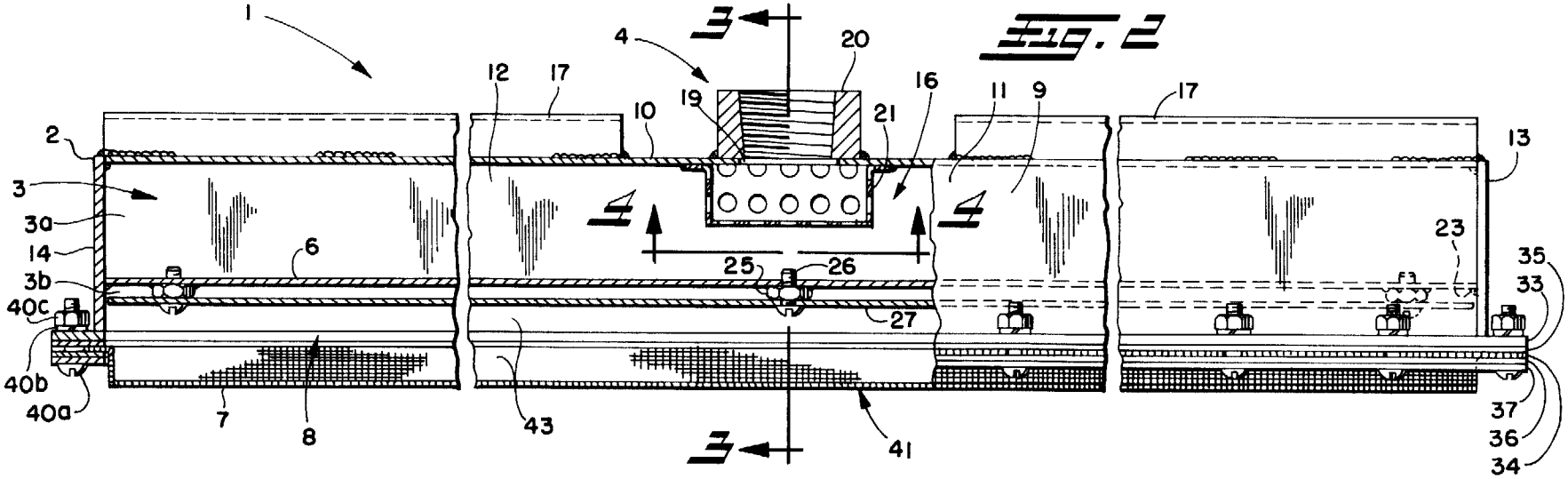
FIG. 2 is a side view, partly broken away in section, of the infrared heater of FIG. 1.
Figure 5:
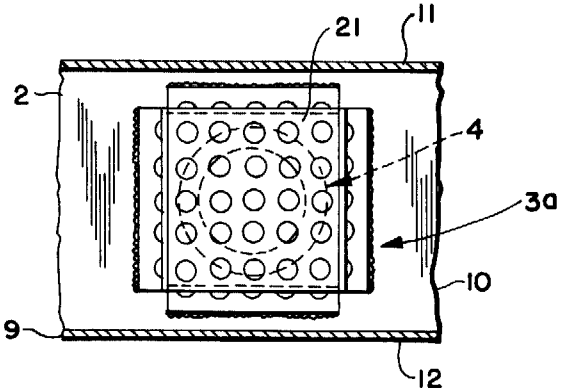

Referring now more particularly to the drawings, wherein like reference numerals designate like parts in the several figures, an infrared energy generator in accordance with the invention is generally indicated at 1 in FIGS. 1 and 2. The fundamental elements of the infrared generator 1 include a hollow housing 2 within which a plenum 3 is formed, a fuel input orifice 4 to the plenum and a fuel output 5 from the plenum, seen most clearly in FIG. 3, a fuel flow impeding orifice plate 6 located in the plenum and dividing the same into upper and lower plenum chambers 3a, 3b, and a radiating screen 7 secured to the housing over its open face 8.

The housing 2 may comprise a stamped sheet metal body 9, which has a top wall 10 and opposite sidewalls 11, 12, and a pair of sheet metal end plates 13, 14 welded to the body 9 to form an integral fluid-tight structure preferably open only at the input orifice 4 and at its open face 8 leading to the hollow interior 16 of the housing. A plurality of hangers 17, such as angle irons, are welded to the top wall 10 of the housing to facilitate mounting the infrared heater 1, for example, on a boom extending from a vehicle in position over a raod bed to expedite drying of the same.

Figure 3:
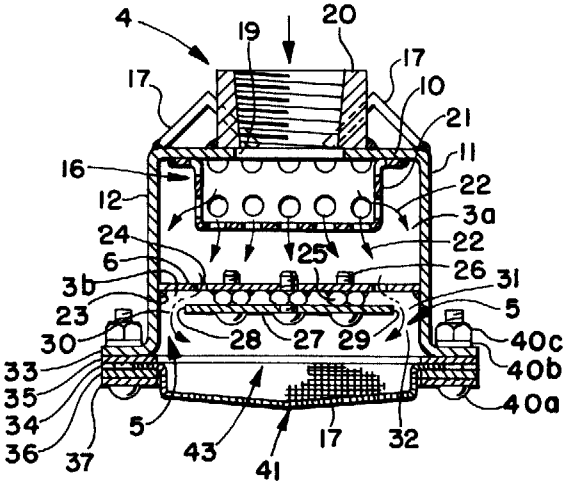
FIG. 3 is a section view looking generally in the direction of the arrows 3—3 of FIG. 2.

As is shown most clearly in FIGS. 1, 2 and 3, the input orifice 4 includes an opening 19 in the top wall 10 of the housing 2 and a fuel entry fitting 20, such as a typical pipe fitting, which is welded or otherwise secured to the top of the wall so that the hollow interior tubular volume of the fitting is generally aligned within the opening 19 in the top wall and provides a fluid-tight path from a fuel supply pipe, not shown, to the plenum 3. The fuel supply pipe preferably brings a pre-mixed fuel supply, including a combustible gas, such as vaporized propane, and air mixture, from a source, not shown, to the infrared heater 1. Such a fuel source, which may comprise a mobile liquid propane tank, will usually provide fuel to the infrared heater at a relatively low pressure, say on the order of about four inches on a water column. Reference to fuel herein, then, means a pre-mixed combination of air and combustible gas or vapor, such as propane. A primary fuel diffuser 21, shown in FIGS. 1 through 4, may be a screen or formed sheet metal with a plurality of holes drilled therethrough and is attached to the interior side of the housing top wall 10 over the input orifice 4 to effect distribution of the fuel received from the input orifice 4 relatively evenly throughout the upper plenum chamber 3a, as is depicted by the arrows 22.

The orifice plate 6 is approximately the same length and width dimension as the interior rectangular length and width dimensions of the housing 2, for example, say from about three to five inches wide and from about ten to forty inches long, and the orifice plate, which is preferably of a metal similar to that of which the housing 2 is formed, is welded at 23 about its perimeter to the housing side and end walls for mechanical support of the orifice plate in the housing and preferably to avoid fuel flow at the interface of the orifice plate and the housing walls. A plurality of holes 24 in the orifice plate 6 are distributed relatively evenly over the orifice plate to provide flow paths from the upper plenum chamber 3a to the lower plenum chamber 3b, which can be seen most clearly in FIGS. 2 and 3.

It is the function of the orifice plate 6 to impede the flow of fuel from the upper plenum chamber 3a to the lower plenum chamber 3b and thereby to create a back pressure in the upper plenum chamber or, in other words, a pressure in the upper plenum chamber that is larger than the pressure in the lower plenum chamber, which in effect is at atmospheric pressure, or just slightly greater than atmospheric pressure to assure continued fuel flow for combustion, due to the large opening or exposure provided at the plenum fuel output 5. The back pressure assures fuel flow in the positive direction and at a suitable velocity to avoid blow out and backfires. Therefore, the sum total of the effective cross-sectional areas of the holes 24 perpendicular to the major flow direction therethrough is smaller than the effective cross-sectional area of the input orifice 4 perpendicular to the major flow direction through the latter. The total area of the holes 24 is on the order of from about fifteen percent (15%) to about forty percent (40%) less than the cross-sectional area of the input orifice, with the preferred range being on the order of from about twenty percent (20%) to about thirty percent (30%) less. For convenience, the cross-sectional area of the input orifice may be considered to be the hollow interior cross-sectional area of the fuel input fitting 20, which has approximately the same cross-sectional area of the fuel pipe, not shown, and the opening 19.

Moreover, in one successfully tested embodiment of the invention, the orifice plate 6 included 2 rows of 38 $\frac{1}{8}$ inch diameter holes substantially evenly distributed over the approximately 40 inch length of the orifice plate, and the input orifice was a $1\frac{1}{4}$ inch pipe fitting. Although the actual inner diameter of such a pipe fitting is slightly larger than $1\frac{1}{4}$ inch, the total area of the holes 24 in the described tested embodiment was at least approximately twenty-six (26) percent less than the cross-sectional area of the input fitting. The pre-mixed fuel supplied to such tested infrared generator was a mixture of vaporized propane derived from a relatively mobile liquid propane tank and air, and the relative back pressure or fluid pressure in the upper plenum chamber 3a was approximately $1\frac{1}{2}$ inches on a water column, while the pressure in the larger plenum chamber was approximately equal or just slightly larger than atmospheric pressure, as described above.

While the magnitude of the back pressure in the upper plenum chamber 3a relative to atmospheric pressure may vary in accordance with the ratio of the total area of the holes 24 and the effective area of the input orifice 4 and with the pressure of the fuel supplied from the fuel source, during normal operation of the infrared generator 1 it is desired that the back pressure in the upper plenum chamber 3a be greater in magnitude than that of the atmospheric pressure at or near which the lower plenum chamber 3b is usually maintained in order to assure fuel flow in a positive direction, i.e. from the input orifice 4 through the holes 24 in the orifice plate 6 and then through the fuel output 5. Moreover, although a single hole or slot or a plurality of holes or slots, which are larger in size but smaller in number than the illustrated holes 24 and which present a cross-sectional area approximately equal to the total area of the holes 24, may be substituted in their place in the orifice plate 6 to provide an equivalent function of impeding flow through the orifice plate and increasing the back pressure in the upper plenum chamber 3*a*, the plurality of holes illustrated are preferred in order to obtain a relatively even distribution of fuel to the lower plenum chamber 3*b* and to the fuel output 5 for subsequent substantially even distribution of the combustion process in the infrared generator. Also, although the orifice plate 6 is preferably welded about its perimeter of the housing walls, other equivalent means may be employed to mount the orifice plate in the housing and to preclude fuel flow at the interface of the orifice plate perimeter and the confronting housing walls. Alternatively, the controlled fuel flow through the orifice plate 6 actually may be equivalently provided in a relatively accurately determined space between the perimeter of the orifice plate and the confronting housing walls.

A plurality of screw nuts 25 are welded to the bottom surface of the orifice plate 6 to provide for attachment of screws 26 that secure a baffle plate 27 to the subassembly of the housing 2, orifice plate 6, and primary diffuser 21. The screw nuts 25 provide a spacer function to space the baffle plate 27 away from the orifice plate 6, thereby to create or to define the lower plenum chamber 3*b* of which the baffle plate establishes a lower boundary. Although the length dimension of the baffle plate 27 is preferably the same as the orifice plate 6 and the interior length dimension of the housing 2, the width dimension of the baffle plate is somewhat smaller than the width dimension of both the orifice plate and the housing interior so that the two edges 28, 29 of the baffle plate effectively cooperate with the housing sidewalls 11, 12 to define the output passageways 30, 31 of the fuel output 5 from the plenum 3, as can be seen most clearly in FIG. 3. The total area of the output passageways 30, 31 is sufficiently large to provide substantially unimpeded flow of fuel generally in the direction of the arrows 32 and to allow the pressure in the lower plenum chamber 3*b* to approach that of the ambient atmospheric environment externally of the infrared generator 1.

A peripheral flange 33 circumscribes the housing 2 at the open face 8 thereof, and the radiating screen 7 is secured to the flange 33. More specifically, flanged portion 34 of the screen 7 is sandwiched between gaskets 35 and 36, which, respectively, may be of a single part or multiple parts to facilitate expansion and preferably are of heat resistant material, such as asbestos-like material or the like. A metal ring holder 37, which may be comprised of a plurality of metal strips to permit thermal expansion thereof, secures the screen flange 34 and the gaskets 35, 36 to the housing flange 33 by a plurality of screw, washer and nut combinations 40*a*, 40*b*, 40*c*. The gaskets 35 and 36 permit thermal expansion and contraction of the radiating screen 7 without detriment to the latter, isolate the screen heat from the housing flange 33 and ring holder 37, and assure that the combustion products of the combusted fuel pass through the main radiating portion 41 of the screen 7. The radiating screen 7 may be, for example, material comprised of inconel, which is able to withstand the relatively high temperatures to which the radiating screen is brought during operation of the infrared generator 1 and which has desirable infrared radiating characteristics; such an inconel infrared energy radiating screen is sold by the Cleveland Wire Cloth Company of Cleveland, Ohio.

In using the infrared generator 1, a pre-mixed gaseous fuel supply of propane and air, for example, is provided to the fuel entry fitting 20 of the input orifice 4. The fuel is diffused or dispersed relatively evenly in the upper plenum chamber 3a by the primary diffuser 21. The orifice plate 6 assures that the back pressure in the upper plenum chamber 3*a* is larger than the pressure in the lower plenum chamber 3*b*, as fuel flows in a positive direction through the holes 24. Fuel exits the lower plenum chamber 3*b* at the fuel output 5 into the volume 43 bounded by the baffle plate 27 and the screen 7 and from that volume the fuel may flow through the screen to the ambient environment.

By holding a flame adjcent the radiating screen 7, the fuel in the volume 43 may be ignited, and as long as fuel is delivered from the fuel output 5 to that volume fuel combustion normally will continue to occur at the fuel output and/or in the volume 43. Some combustion also may take place in the lower plenum chamber 3*b*, but due to the back pressure in the upper plenum chamber 3*a* and the maintained fuel flow through the holes 24 in the positive direction from the upper to the lower plenum chambers, there normally will not be any combustion in the upper plenum chamber. The screen 7, of course, is exposed to the products of the fuel combustion, and heat generated by such combustion elevates the temperature of the radiating screen 7 to a temperature level such that the screen radiates infrared energy for example, toward the earth for drying the same.

Since the back pressure in the upper plenum chamber 3*a* is relatively higher than atmospheric pressure, fuel flow through the holes 24 of the orifice plate 6 is assured. Therefore, a draft or a wind blowing toward the radiating screen 7 tending to push the fuel back into the upper plenum chamber and ambient atmospheric pressure increases usually will not be able to blow out the continuing combustion process in the infrared generator 1 and especially usually will not be able to blow the combustion back into the upper plenum chamber 3a to cause a backfire at the input orifice 4. Moreover, since the back pressure in the upper plenum chamber 3*a* and fuel flow therethrough in a positive direction are assured, the overall area of the open end face 8 of the housing and the radiating area 41 of the screen 7 may be relatively large, for example, on the order of about 40 inches long and about 3 to 5 inches wide so as to provide the radiated infrared energy over a relatively large output area. Further, due to the back pressure and assured positive fuel flow, several infrared generators may be supplied in parallel from a common fuel source and may be physically positioned to supply infrared energy to a combined even larger overall output area.

Due to its relative insensitivity to wind and changing atmospheric pressure and, therefore, its ability to operate from a relatively low pressure fuel source, the infrared generator 1 of the present invention may be effectively used outdoors for drying earth. During such usage, a plurality of such infrared generators may be supported by their hangers from a vehicle or the like, which may be driven along the proposed road bed, in positional relationship to effect drying of a relatively wide strip of earth of the road bed over which concrete may later be poured during highway construction. This is, of course, but one of the many purposes for which infrared generators in accordance with the invention may be employed. Moreover, it will be appreciated that although the flow impediment and back pressure obtained by the orifice plate of the invention make the infrared energy generator especially useful with low pressure fuels, such as pre-mixed propane and air, the principles of the invention also may be employed with infrared energy generators that use other types of low or higher pressure fuels.

The embodiments of the invention in which an exclusive property or privilege is claimed are defined as follows:

1. An infrared energy generator, comprising:

a housing, a plenum in said housing, input means for coupling to said plenum a combustible fuel input at a pressure greater than relative ambient pressure outside said housing, output means for directing fuel out from said plenum for combustion thereof, radiating means exposed to the products of such combustion for radiating infrared energy in response to such products, said radiating means also being exposed to the ambient environment to radiate such infrared energy thereto, means for impeding fuel flow through said plenum from said input means to said output means to maintain a fuel back pressure in at least a portion of said plenum exposed to said input means normally larger than normal pressure of the ambient environment to which such radiating means is exposed, said means for impeding flow including opening means of a size relative to the magnitude of such back pressure for passing fuel to said output means at a sufficient flow velocity that impedes back flashing and a sufficient fuel quantity to maintain combustion at said radiating means, said means for impeding comprising a substantially solid member in said plenum dividing the latter into first and second portions, the former being more proximate said input means than the latter, said opening means producing at least one controlled fuel flow stream therethrough, and said opening means, such back pressure, and the flow velocity of said at least one fuel flow stream being cooperably interrelated to maintain combustion at said radiating means and to prevent back flashing thus avoiding backfire, and baffle means in said housing facing said second portion of said plenum for forming a boundary thereof, said baffle means being positioned between said opening means and said radiating means to block said at least one fuel flow stream from flowing directly from the former to the latter thereby deflecting said at least one fuel flow stream and spreading the same, whereby the fuel supplied for combustion at said radiating means is substantially uniformly distributed thereat.

2. An infrared energy generator as set forth in claim 1, wherein said opening means comprises a plurality of opening means distributed over said member for producing a plurality of controlled fuel flow streams therethrough.

3. An infrared energy generator as set forth in claim 2, wherein said input means has an effective cross-sectional area through which fuel flows into said plenum, and the sum of the effective cross-sectional areas of said opening means is smaller than said effective cross-sectional area of said input means.

4. An infrared energy generator as set forth in claim 3, wherein said sum of the effective cross-sectional areas of said opening means is approximately on the order or from about fifteen percent to about forty percent less than said effective cross-sectional area of said input means.

5. An infrared energy generator as set forth in claim 4, wherein said sum of the effective cross-sectional areas of said opening means is approximately on the order of from about twenty percent to about thirty percent less than said effective cross-sectional area of said input means.

6. An infrared energy generator as set forth in claim 2, wherein said substantially solid member comprises a plate in said plenum.

7. An infrared energy generator as set forth in claim 6, wherein said plate and said radiating means have respective effective cross-sectional areas that are appreciably larger than the sum of the effective cross-sectional areas of said opening means through which fuel flows.

8. An infrared energy generator as set forth in claim 7, wherein said sum of the effective cross-sectional areas of said opening means is approximately on the order of less than about five percent of said effective cross-sectional areas of said plate and radiating means.

9. An infrared energy generator as set forth in claim 6, wherein said plurality opening means comprises a plurality of hole means through said plate and distributed thereover for substantially evenly distributing fuel to said second portion and subsequently to said output means such that the fuel flow velocity in each fuel flow stream exceeds the back flashing velocity and the quantity of fuel delivered for combustion at said radiating means is sufficient to maintain combustion thereat.

10. An infrared energy generator as set forth in claim 6, wherein said baffle means is positioned in said housing between said opening means and said radiating means to block all of said fuel flow streams from flowing directly from the former to the latter.

11. An infrared energy generator as set forth in claim 10, wherein said output means comprises open space between said baffle means and said housing means to permit fuel flow from said second portion of said plenum for combustion thereof.

12. An infrared energy generator as set forth in claim 11, further comprising means for supporting said baffle means in said housing directly from said plate.

13. In an infrared energy generator, which includes a housing, a plenum in said housing, input means for coupling a relatively low pressure supply of fuel to said plenum, output means for directing fuel out from said plenum for combustion thereof, and radiating means exposed to the products of such combustion for radiating infrared energy, the improvement comprising means responsive to pressure of fuel in one portion of said plenum relatively proximate said input means for directing a flow of fuel in a positive direction at a velocity exceeding the flashback velocity from said one portion to a second portion of said plenum relatively more remote from said input means and exposed to said output means for combustion of such fuel at said radiating means without flashback and subsequent backfires, and baffle means positioned in said housing between said means for directing and said radiating means for deflecting said flow of fuel and spreading the same for delivery to said output means, whereby the fuel supplied for combustion at said radiating means is substantially uniformly distributed thereat.

14. In the generator of claim 13, wherein said means for directing comprises orifice plate means for impeding fuel flow from said one portion to said second portion of said plenum, and wherein the velocity of fuel flow is such that provides a cooling effect at and proximate said orifice plate further to reduce the possibility of flashback.

15. In the generator of claim 14, wherein said radiating means has a surface area exposed to the ambient environment of the generator, and said surface area is appreciably larger than about four square inches.

16. An infrared energy generator as set forth in claim 1, wherein said baffle means comprises a substantially solid plate-like member.

17. An infrared energy generator as set forth in claim 8, wherein said cross-sectional areas of said plate and radiating means are greater than about fifty square inches.

18. An infrared energy generator as set forth in claim 10, wherein said baffle means shields at least part of said plate from heat generated by combustion at said radiating means.

19. In the generator of claim 13, wherein said baffle means comprises a substantially solid plate-like member positioned in said housing to shield at least part of said means for directing from heat generated by combustion at said radiating means.

* * * * *